US007147061B2

(12) United States Patent
Tsutaoka et al.

(10) Patent No.: US 7,147,061 B2
(45) Date of Patent: Dec. 12, 2006

(54) FIRE EXTINGUISHER KIT, DEVICE AND METHOD OF USING SAME

(75) Inventors: Neil Tsutaoka, Honolulu, HI (US); Pio Jimenez, Honolulu, HI (US)

(73) Assignee: Future Innovation Trading, Inc.

( * ) Notice: Subject to any disclaimer, the term of this patent is extended or adjusted under 35 U.S.C. 154(b) by 0 days.

(21) Appl. No.: 11/129,234

(22) Filed: May 13, 2005

(65) Prior Publication Data

US 2006/0254783 A1 Nov. 16, 2006

(51) Int. Cl.
*A62C 35/08* (2006.01)
*A62C 35/02* (2006.01)
*A62C 37/14* (2006.01)

(52) U.S. Cl. ..... 169/28; 169/26; 169/58

(58) Field of Classification Search ..... 169/28, 169/26, 58, 30, 46, 56, 71, 72, 77, 84
See application file for complete search history.

(56) References Cited

U.S. PATENT DOCUMENTS

| | | | | |
|---|---|---|---|---|
| 228,621 | A | 6/1880 | Folsom | |
| 336,981 | A | 3/1886 | Bartlett | |
| 338,604 | A | 3/1886 | Luyster | |
| 370,874 | A | 10/1887 | Johnson | |
| 655,599 | A | 8/1900 | Braunwalder | |
| 695,847 | A * | 3/1902 | Van Valkenburg et al. | 169/28 |
| 798,623 | A | 9/1905 | Bartlett | |
| 883,856 | A | 4/1908 | Bowmen | |
| 964,299 | A | 7/1910 | McCall | |
| 1,297,172 | A | 3/1919 | Hughes | |
| 1,489,703 | A * | 4/1924 | Johnson | 169/28 |
| 2,073,416 | A | 3/1937 | Finzi | |
| 2,074,648 | A | 3/1937 | Haimann | |
| 2,091,589 | A | 8/1937 | Finzi | |
| 2,665,768 | A | 1/1954 | Talbot | |
| 2,873,806 | A | 2/1959 | Bittner | |
| 3,833,063 | A | 9/1974 | Williams | |
| 4,285,403 | A | 8/1981 | Poland | |
| 4,328,867 | A * | 5/1982 | Heath | 169/58 |
| 4,487,266 | A * | 12/1984 | Gillis et al. | 169/51 |
| 4,964,469 | A | 10/1990 | Smith | |
| 5,050,683 | A | 9/1991 | Sayles | |
| 5,224,550 | A | 7/1993 | Bragg | |
| 5,232,053 | A * | 8/1993 | Gillis et al. | 169/58 |
| 5,518,075 | A | 5/1996 | Williams | |
| 5,881,819 | A | 3/1999 | Walters et al. | |
| 5,992,531 | A | 11/1999 | Mikulec | |
| 6,012,531 | A | 1/2000 | Ryan | |
| 6,318,473 | B1 | 11/2001 | Bartley et al. | |
| 6,612,243 | B1 | 9/2003 | Italiane et al. | |
| 6,796,382 | B1 * | 9/2004 | Kaimart | 169/43 |

FOREIGN PATENT DOCUMENTS

| | | |
|---|---|---|
| GB | 438558 | 11/1935 |
| GB | 440012 | 12/1935 |

* cited by examiner

*Primary Examiner*—David A. Scherbel
*Assistant Examiner*—Darren Gorman
(74) *Attorney, Agent, or Firm*—Jerry R. Potts

(57) ABSTRACT

A fire extinguishing kit includes a self-contained wall mountable fire-extinguishing device having a base plate with an upstanding igniter and a depending non-projectile thermal actuator. The base plate is surrounded by a hollow frangible hull, which in turn is supported by another base plate, which also supports from below a distal end portion of the depending non-projectile thermal actuator. The hollow frangible hull is loaded with a sufficient amount of a dispersible dry fire-fighting chemical agent to facilitate extinguishing a small-localized fire when dispersed by the isotropic explosive force of the igniter.

20 Claims, 9 Drawing Sheets

FIRE EXTINGUISHER KIT, DEVICE AND METHOD OF USING SAME

BACKGROUND OF THE INVENTION

Background of Prior Art

There have been many different types and kinds of explosive fire extinguishing devices introduced in the prior art. For example, reference may be made to the following published documents:

| | INVENTOR | DATE OF ISSUANCE |
|---|---|---|
| U.S. PAT. NO. | | |
| 228,621 | Folsom | Jun. 8, 1880 |
| 336,981 | Bartlett | Mar. 2, 1886 |
| 338,604 | Luyster | Mar. 23, 1886 |
| 370,874 | Johnson | Oct. 4, 1887 |
| 655,599 | Braunwalder | Aug. 7, 1900 |
| 798,623 | Bartlett | Sep. 5, 1905 |
| 883,856 | Bowmen | Apr. 7, 1908 |
| 964,299 | McCall | Jul. 12, 1910 |
| 1,297,172 | Hughes | Mar. 11, 1919 |
| 2,073,416 | Finzi | Mar. 9, 1937 |
| 2,074,648 | Haimann | Mar. 23, 1937 |
| 2,091,589 | Finzi | May 4, 1935 |
| 2,665,768 | Talbot | Jan. 12, 1954 |
| 2,873,806 | Bittner | Feb. 17, 1957 |
| 3,833,063 | Williams | Sep. 3, 1974 |
| 4,285,403 | Poland | Aug. 25, 1981 |
| 4,964,469 | Smith | Oct. 23, 1990 |
| 5,050,683 | Sayles | Sep. 24, 1991 |
| 5,224,550 | Bragg | Jul. 6, 1993 |
| 5,518,075 | Williams | May 21, 1996 |
| 5,881,819 | Walters et al. | Mar. 16, 1999 |
| 5,992,531 | Mikulec | Nov. 30, 1999 |
| 6,012,531 | Ryan | Jan. 11, 2000 |
| 6,318,473 | Bartley et al. | Nov. 20, 2001 |
| 6,612,243 | Italiane et al. | Sep. 2, 2003 |
| 6,796,382 | Kaimart | Sep. 28, 2004 |
| GB PATENT NO. | | |
| 438,558 | Finzi | Nov. 19, 1935 |
| 440,012 | Finzi | Dec. 18, 1935 |

With respect to these prior art documents, of particular interest are the following:

G.B. 440,012 by Finzi describes a fire-extinguishing device having a frangible containment vessel with a generally spherical shape. The containment vessel is formed from a low-density frangible material and is filled with a fire extinguishing material that surrounds an explosive device. A temperature sensitive fuse, coupled to the explosive device, causes the explosive device to detonate when the fuse is exposed to an elevated temperature. When the explosive device detonates, it breaks the containment vessel and disperses the fire extinguishing material over a localized area.

U.S. Pat. No. 883,856 by Bowman discloses a rectangular shaped fire extinguisher, which holds a fire retardant material that surrounds an explosive charge. The explosive charge extends from one end of the container to the other end of the container. A wick fuse extends out from one end of the fire extinguisher.

U.S. Pat. No. 2,873,806 by Bittner teaches a cylindrically shaped fire extinguisher, that holds a centrally disposed explosive charge which is surrounded by a fire retardant material. A fuse extends from one end of the container into the center of the container for igniting the explosive charge.

U.S. Pat. No. 5,881,819 by Walters et al. discloses a heat sensitive fuse coupled to an explosive charge, where the fuse extends through an opening for activation after the temperature in the area of the device reaches a given high level.

U.S. Pat. No. 6,796,382 by Kaimart illustrates a spherical shaped fire extinguisher with a centrally disposed detonator, which contains an explosive charge. A fire retardant material surrounds the detonator. A fuse extends from the outer surface of the extinguisher to the detonator.

While the above-mentioned prior art devices were satisfactory for some applications, there is, nevertheless, a need for a new and improved fire extinguishing kit and device, which is safe, effective and relatively inexpensive.

BRIEF SUMMARY OF THE INVENTION

A fire extinguishing kit includes a self-contained wall or ceiling mountable fire-extinguishing device having a base plate with an upstanding igniter and a depending non-projectile thermal actuator. The base plate is surrounded by a hollow frangible hull which in turn is supported by another base plate which also supports from below a distal end portion of the depending non-projectile thermal actuator. The hollow frangible hull is loaded with a sufficient amount of a dispersible dry fire-fighting chemical agent to facilitate extinguishing a small-localized fire when dispersed by the isotropic explosive force of the igniter.

DETAILED DESCRIPTION OF THE PREFERRED EMBODIMENTS OF THE INVENTION

Figure 2:
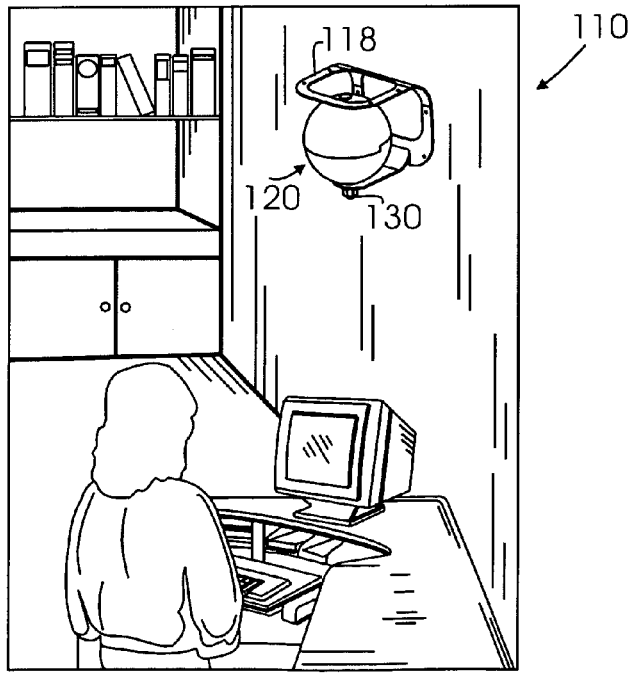
FIG. 2 is a greatly reduced perspective view of a fire extinguisher assembly forming part of the fire extinguisher kit of FIG. 1.

Referring now to the drawings and more particularly to 1–3 there is illustrated a fire extinguishing kit 10 and explosive device 110, which are constructed in accordance with a preferred embodiment of the present invention. As best seen in FIG. 2, the explosive fire-extinguishing device 110 is self-contained and mounts easily and conveniently to any flat supporting surface, such as wall or ceiling. As will be explained hereinafter in greater detail, the explosive device 110 is relatively inexpensive, very effective and does not present any serious safety hazard when it explodes.

Figure 1:
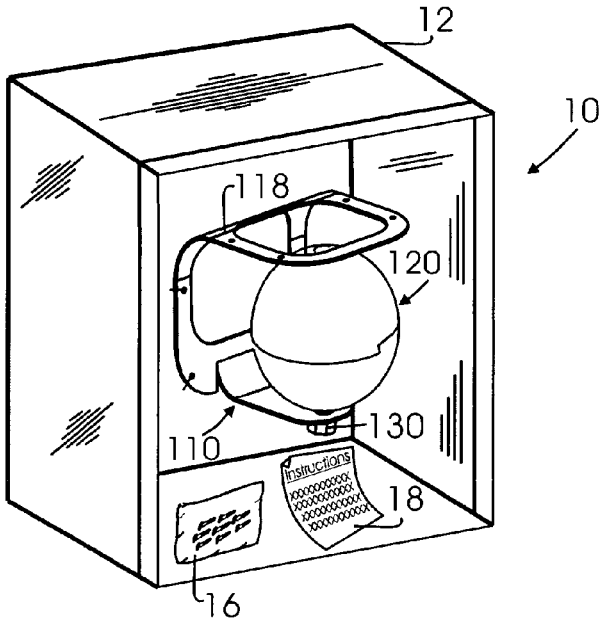
FIG. 1 is a greatly reduced perspective view of a fire extinguisher kit, which is constructed in accordance with an embodiment of the present invention.

Considering now the kit 10 in greater detail with reference to FIG. 1, the fire-extinguishing kit 10 generally comprises a container or storage box 12 having a display window 14, which allows a prospective purchaser to easily see the contents of the kit 10. In this regard, a prospective purchaser can easily see that the kit 110 includes the fire extinguishing device 110, mounting hardware indicated generally at 16, and a set of instructions 18.

Figure 3A:
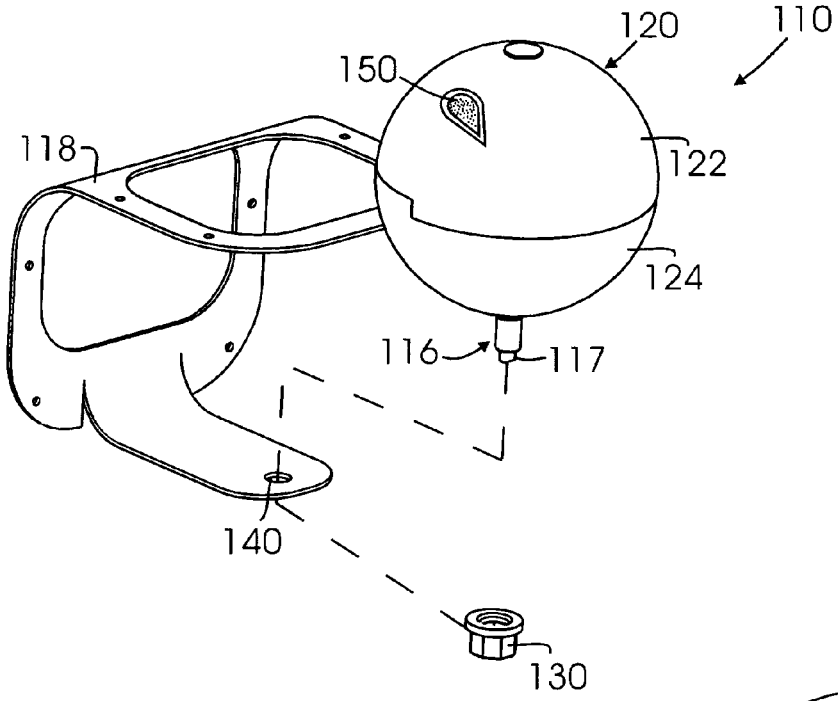
FIG. 3A is an exploded view of the fire extinguisher assembly of FIG. 2.
Figure 3B:
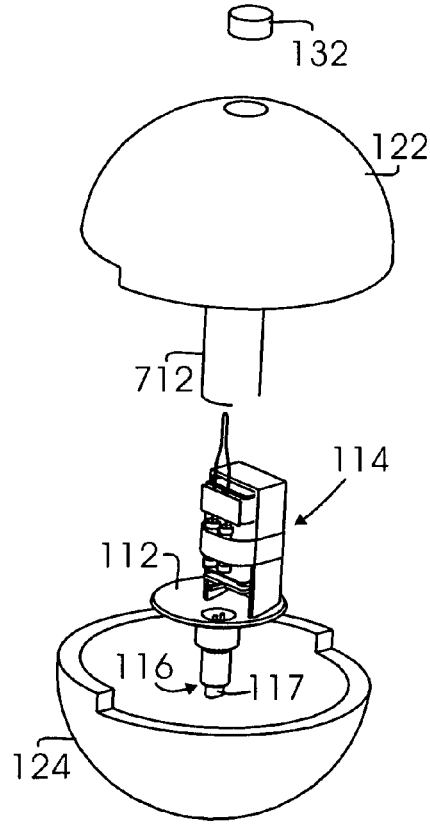
FIG. 3B is an exploded view of a fire extinguisher forming part of the fire extinguisher assembly of FIG. 3A.
Figure 4A:
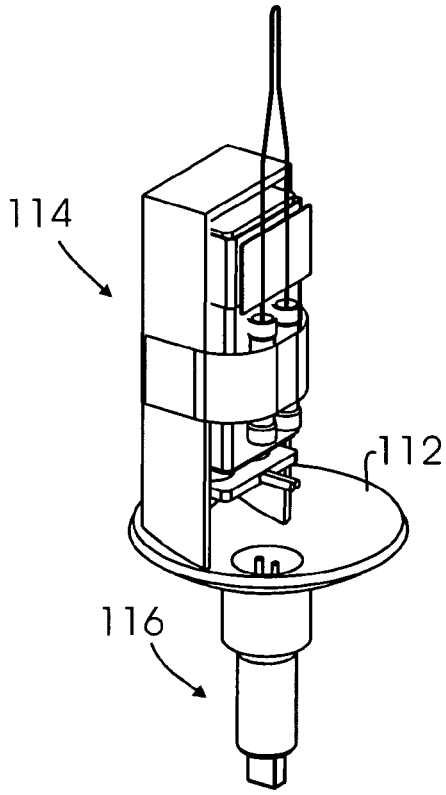
FIG. 4A is a perspective view of an igniter assembly forming part of the fire extinguisher of FIG. 3B.
Figure 4B:
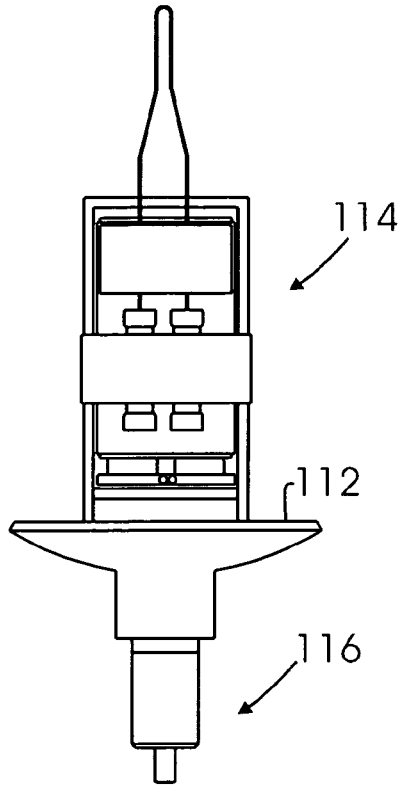
FIG. 4B is a front plane view of the igniter assembly of FIG. 4A.
Figure 4C:
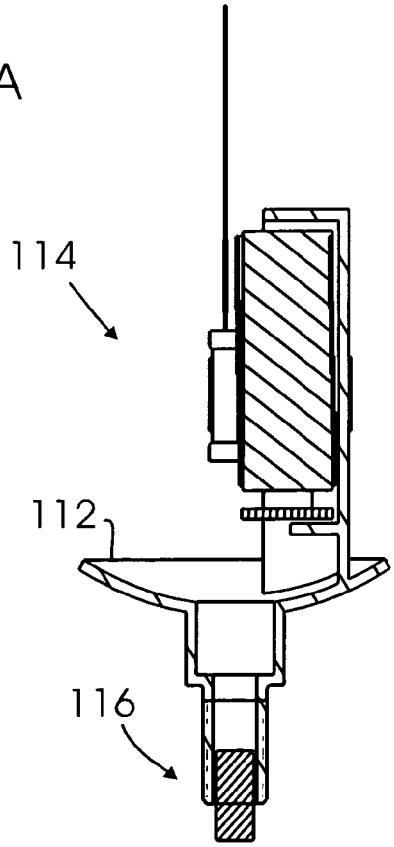
FIG. 4C is a side elevational view of the igniter assembly of FIG. 4A.
Figure 10:
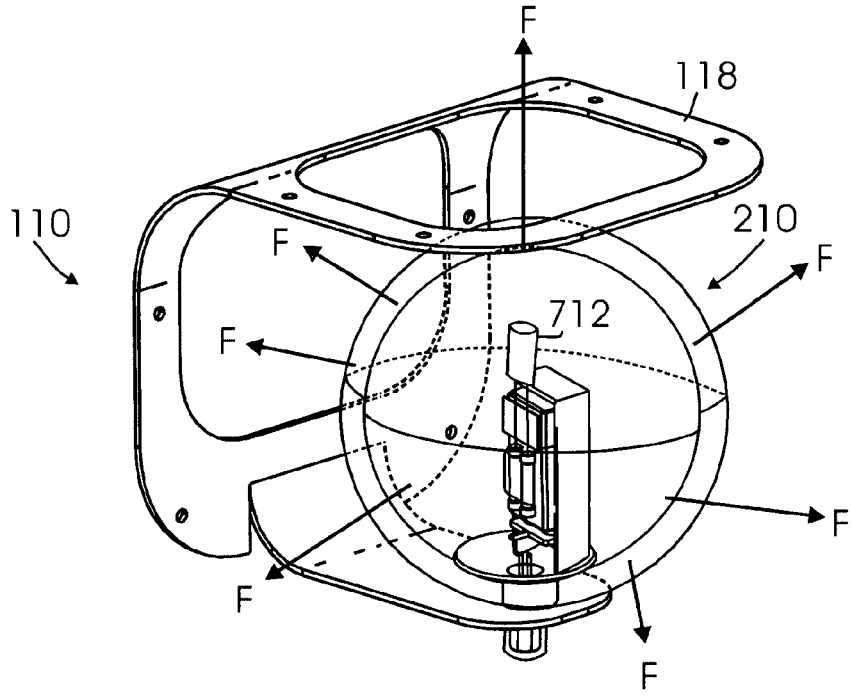
FIG. 10 is a digrammatic view of the fire-extinguishing device of FIG. 2, illustrating diagrammatically the isotropic explosive force F generated upon explosion of the fire-extinguishing device.

Considering now the fire-extinguishing device 110 in greater detail with reference to FIGS. 2–4, the fire-extinguishing device 110 is a self-contained mountable unit which includes a base plate or internal bracket 112 (FIG. 3) having an upstanding detonator or igniter unit 114 mounted to a top surface thereof to facilitate generating a substantially isotropic explosive force F (FIG. 10). As will be explained hereinafter in greater detail, the internal bracket 112 has a sufficient structural strength to function as an explosive shield against the explosive force of the igniter unit 114 when it is detonated. In order to cause the igniter unit 114 to be detonated, the fire-extinguishing device 110 further includes a non-projectile thermally actuated switch or actuator 116 which is enclosed within a two tiered support, indicated generally at 618 (FIG. 6C), that depends downwardly from a bottom surface area of the base plate 112. In short, in response to a rise in temperature caused by a fire situation, the thermal actuator 116 activates the igniter 114, which is a pyrotechnic detonator.

The fire-extinguishing device 110, further includes another base plate or external bracket 118, which supports from below a distal end portion 117 of the depending non-projectile thermal actuator 116 as well as a hollow frangible hull 120 that surrounds the internal bracket 112. The external bracket 118, as best seen in FIG. 3B, also supports from below the hull 120. The hull 120 is loaded with a sufficient amount of a dispersible dry fire fighting or fire-extinguishing material 150 to facilitate extinguishing a small-localized fire when dispersed by the isotropic explosive force of the igniter 114.

Considering now the fire extinguishing device 110 in still greater detail, the fire extinguishing device 110 generally includes four major components: (a) a containment vessel or hull 120 composed of a plastic foam material such as polystyrene foam or expanded polystyrene foam; (b) an igniter 114 carrying an explosive charge 712 (in combination sometimes called an explosive device 114); (c) a dry powder type of fire extinguishing material 150, such as ammonium phosphate or sodium carbonate surrounding the explosive device 114 and confined within the containment vessel 120 by the explosive shield 112 which supports from below both the explosive device 114 and the fire extinguishing material 150; and (d) an external bracket 118, which supports from below: a) the internal bracket 112; b) the thermally sensitive actuator 116 depending from the explosive shield 112, and c) the containment vessel 120. This unique arrangement of the brackets 112 and 118 in combination with the explosive device 114, thermally sensitive actuator 116, and low density, rigid plastic containment vessel 120, which is loaded with the fire extinguishing material 150, provides a highly efficient and extremely safe fire extinguishing capability. More particularly, upon denotation of the explosive device 114, the fire-extinguishing device 110 will fragment into a plurality of low-density fragments, which are substantially harmless to a human in close proximity thereto. Moreover, the explosive device 110 is also harmless to the auditory system of a human in close proximity to the device 110 when the explosive device 114 detonates.

It should be noted that in the above-described arrangement, it is important that the outer hull 120 have a uniform thickness throughout to ensure that there is an equal dispersion of the pressure forces to cause the fire retardant material 150 to spread out in a generally spherical pattern in response to the explosive force generated by the explosive device 114. In addition to the thickness and density of the hull structure 120, it should be noted that the polystyrene foam material itself affects the spread pattern of the chemical agent 150. That is, if the structural material of the hull 120 were very dense and thick, the explosive charge of the igniter 114 would cause the hull to violently explode which would degrade the structural integrity of the hull 120. However, if the hull is composed of a low-density rigid plastic or foam material, which is thin and uniform, the hull 120 will explode and fragment only with a sufficient force to cause the fire retardant agent 150 to be dispersed in a circular pattern over a localized area. In short then, the density of the foam material is not so important as the density of the foam coupled with the thickness of the hull wall. In this regard, it has been found that a density of less that one-pound per cubic foot is preferred which results in a thickness of about 0.375 inches.

It should also be understood that the isotropic distribution of the explosive force generated by the explosive device 114 helps to reduce the resultant forces on the central actuator structure 116. That is, in case of the hull 120, which has a sphere or ball-like structure, the explosive charge of the device 114 is placed at about a location, which is coincident with the geometric center of the spherical geometry of the hull 120. In this regard, when the device 114 explodes, a nearly isotropic distribution of pressure radiates from the center of the charge since this source point is strategically located at about the geometric center of the hull 120. Because of this radiating distribution of pressure, and the separation between the charge 712 and the internal bracket 112, only a small resultant force of energy is directed at the internal bracket 112, thus, greatly reducing the likelihood of any projectiles and any type of structural failure of external bracket 118.

From the foregoing, it should be understood by those skilled in the art, that the non-projectile producing actuator is created by the structural arrangement of the various component parts of the device 110, which are tied into the mounting brackets 112 and 118 respectively. Whether the explosive force is equal/isotropic or non-isotropic, the design of the preferred embodiment of the present invention will not produce any projectile as long as the resultant force of the device 114 when it explodes is less than the structural failure rating of the structure brackets 112 and 118 respectively.

Figure 5A:
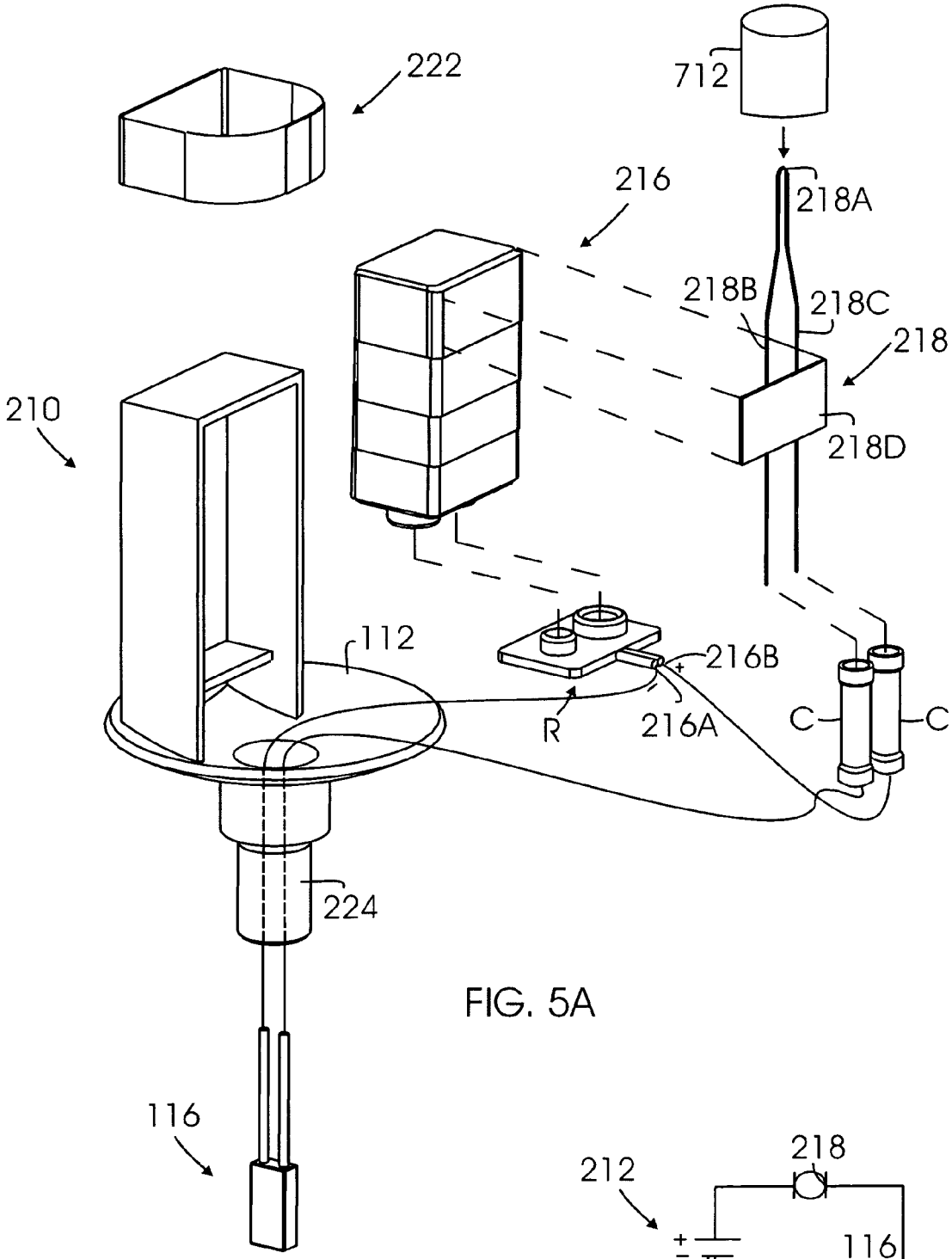
FIG. 5A is an exploded view of an igniter assembly forming of FIG. 4A.
Figure 5B:
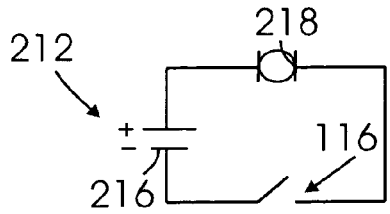
FIG. 5B is a circuit diagram of an igniter circuit forming part of the igniter assembly of FIG. 4A.
Figure 6A:
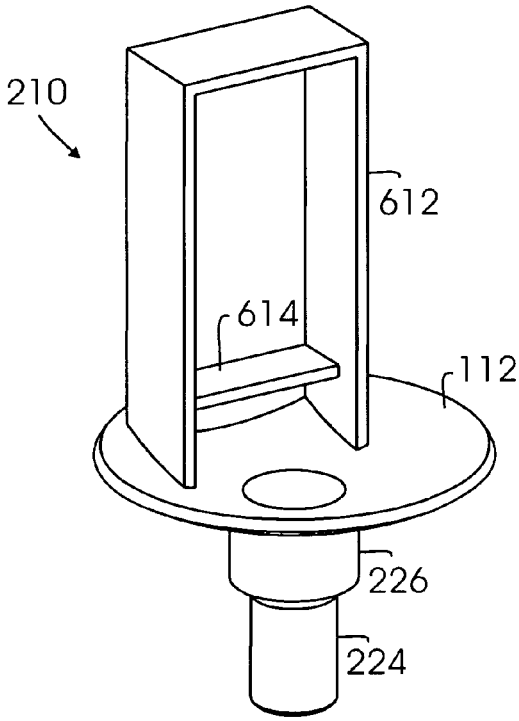
FIG. 6A is a perspective view of an igniter holder forming part of the igniter assembly of FIG. 4A.
Figure 6B:
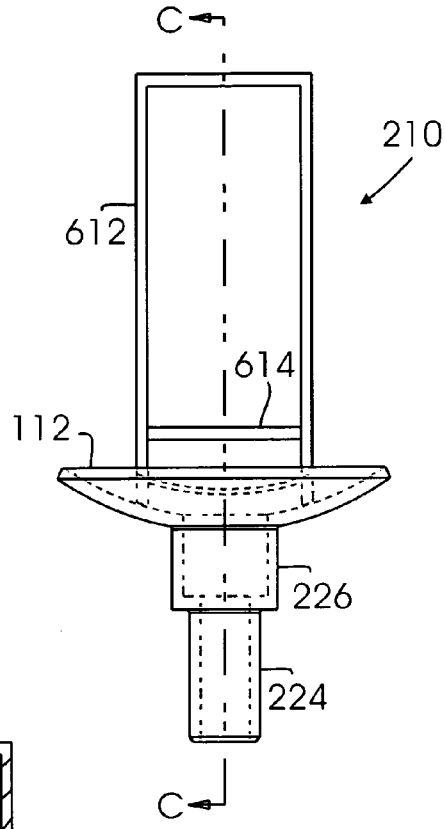
FIG. 6B is a front plane view of the igniter holder of FIG. 6A.
Figure 6C:
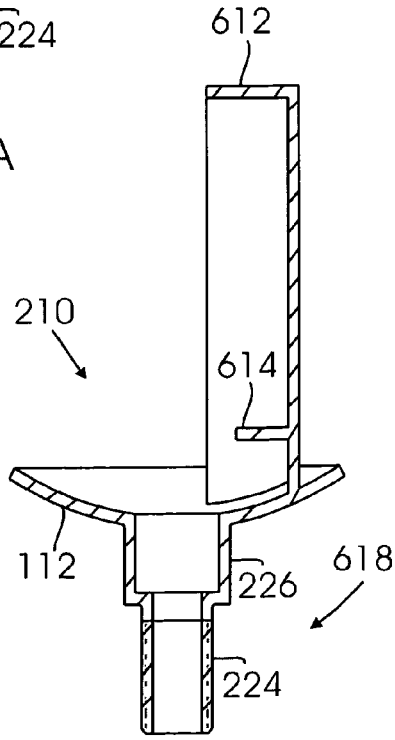
FIG. 6C is a side elevational sectional view of the igniter holder of FIG. 6B taken substantially along line C—C.

Considering now the igniter 114 in greater detail with reference to FIGS. 4–6, the igniter unit 114 generally includes a holder 210 (FIG. 5A), which is mounted to the base plate 112. The holder 210 is includes an internal shelf S, which is adapted to support from below a battery receptacle R, an electrical source 216, such as a battery, and an igniter 218 which is part of an igniter circuit 212 (FIG. 5 B) that includes the thermal sensitive switch 116, and a pair of wire connectors C, and wire splices 216 A and 216B respectively. The igniter circuit 212, or more specifically the thermal switch 116 is adjustable to various temperatures, which may be anticipated in response to an accidental or inadvertent fire sources. More particularly, the thermally sensitive switch 116 may be chosen for a specific or desired set point, such as a 72 degree C. set point. It should be noted that some of the temperature sensitive switches currently available may have their set point adjusted within a narrow range of temperatures, if desired. In the preferred embodiment of the present invention, the temperature sensitive switch 116 is chosen with a specific set point, targeted at a specific application.

The device 114 of the fire-extinguishing device 110 is unique because it is a temperature sensitive trigger mechanism, which is housed within a self-contained unit that does not require an external power source. In this regard, the low cost components of the fire-extinguishing unit 110 are combined in a unique and novel manner. The temperature sensitive switch 116 enables the unit 110 to monitor the ambient temperature without consuming any power as the switch 116 remains in an open position until triggered by a sufficient ambient temperature rise to cause the switch 116 to close, which in turn allows the electrical current to flow in the igniter circuit 212. The battery 216 remains passive until energy is requested through the tripping of the switch 116. The explosive charge 712 also remains idle until set off by the device 114. Once the explosive charge 712 is detonated by the igniter circuit 212, the fire extinguishing material 150 is dispersed in a controlled manner (uniform pressure distribution) to put out a small-localized fire.

As best seen in FIGS. 4–5, the component parts of the igniter unit or assembly 114 are secured together with epoxy and electrical tape 222. In this regard, the electrical tape 222 is secured to the holder 210 and the connectors C, while the epoxy is utilized to fix the thermal switch 116 into a downwardly depending support 618.

Considering now the holder 210 in greater detail, the holder 210 has a generally rectangular box-like frame 612 as best seen in FIG. 6 with an inner shelf 614. The frame 612 is secured to the top surface area of the shield 112 and is aligned to position the explosive charge 220 at about the geometric center of the hull 120. In one preferred embodiment the holder 210 is composed of the same material as the hull 120 in order to help eliminate dangerous and sharp projectiles from being formed when the explosive charge 712 is detonated.

Figure 7A:
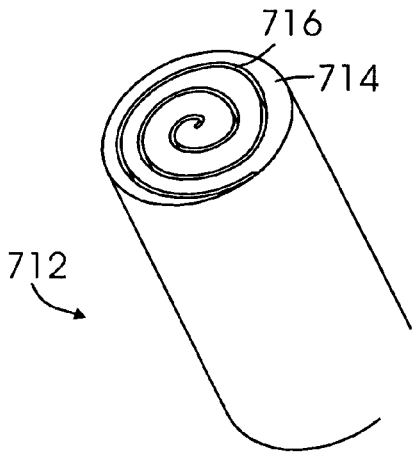
FIG. 7A is a perspective view of a batting assembly forming part of the igniter assembly of FIG. 4A.
Figure 7B:
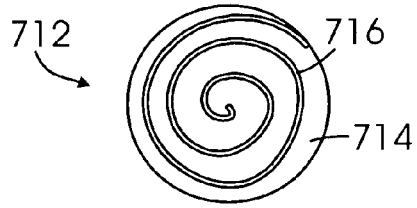
FIG. 7B is a top plane view of the batting assembly of FIG. 7A.
Figure 7C:
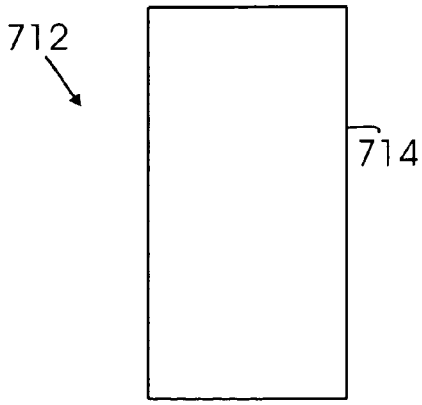
FIG. 7C is a front plane view of the batting assembly of FIG. 7A.

Considering now the explosive charge 712 in greater detail with reference to FIGS. 4 and 7, the explosive charge 712 generally includes a roll of cotton batting 714, which has gun powder or other suitable explosive 716 spread across its inner surface. The cotton batting 714 is then rolled into a tight cylinder-like configuration compacting the gun powder 716 in spaced apart layers as best seen in FIGS. 7A and 7B. The rolled batting 714 is then secured to itself to form a small compact unit, which can be easily and conveniently mounted to the igniter 218, and more specifically to the mounting loop 218A as best seen in FIGS. 5A and 10.

Figure 9A:
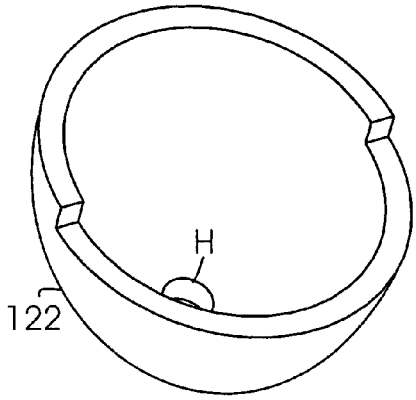
FIG. 9A is a perspective view of a shell forming part of the fire extinguisher assembly of FIG. 3A.
Figure 9B:
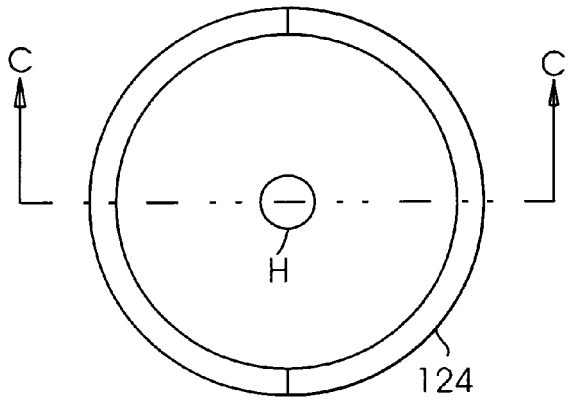
FIG. 9B is a top plane view of the half shell of FIG. 9A.
Figure 9C:
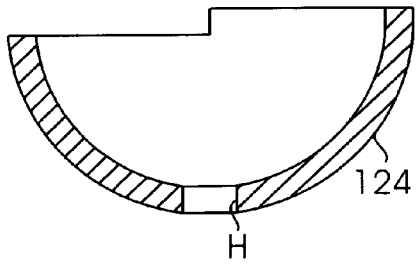
FIG. 9C is a sectional view of the shell of FIG. 9B taken substantially along the line C—C.

Considering now the hull construction 120 in greater detail with reference to FIG. 9, the hull 120 generally includes two semi-spherical half sections indicated generally at 122 and 124 respectively. The half sections 122 and 124 are complementary to one another to mechanically interconnect to form the spherical hull 120. Each half section also includes a centrally disposed hole H within its dome, which, as described earlier, has a uniform thickness throughout.

When the two half sections 122 and 124 are interconnected forming the hull 120, the igniter assembly 114, via the downwardly depending support 618, is positioned within the hull interior aligned within the hole H of the lower section 124. It should be noted that the bracket 112, from which the support 618 depends, is also configured to engage the interior wall of the hull 120 and acts as a further stop or floor for the accumulation of the fire retardant agent 150 which is introduced into the interior of the hull through the hole H disposed in the upper section 122 as will be explained hereinafter in greater detail.

Considering now the downwardly depending support 618 in greater detail with reference to FIG. 6, the support 618, as mentioned before, is a two-tiered support having a lower switch support member 224 and an upper connect member 226. The support members 224 and 226 are generally cylindrical in shape, with the support member 226 having a larger outside diameter than the lower switch support member 224. The outside diameter of the upper member 226, which is integrally connected to the concave bottom area of the disc shaped base plate 112, is sufficiently larger to act as a stop against the hull 120 while the lower support member 224, which has the thermal switch 116 mounted therein, extends through and below the hole H of the lower section 124. The outer wall of the lower support is composed of a soft pliable material, which is sufficiently soft to receive thereon a self-threading mounting bolt 130 (FIG. 3A). In this regard, the mounting bolt is utilized to secure the hull 120 and the internal bracket 112 to the external mounting bracket 118 as best seen in FIGS. 1 and 2.

Figure 8A:
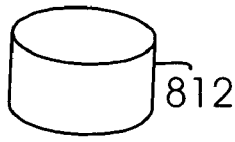
FIG. 8A is a perspective view of a plug forming part of the fire extinguisher assembly of FIG. 3A.
Figure 8B:
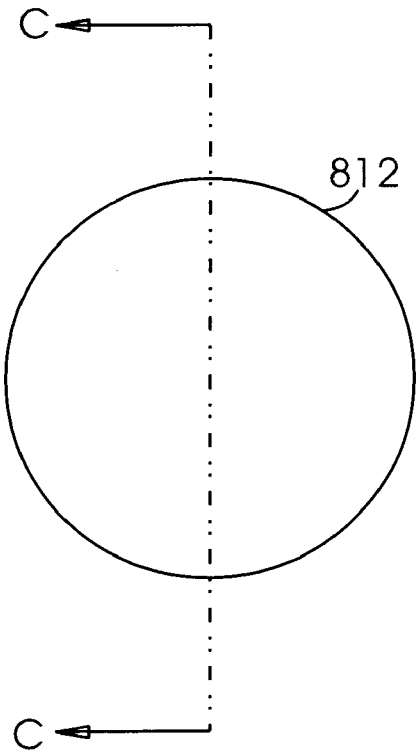
FIG. 8B is a top plane view of the plug of FIG. 8A.
Figure 8C:
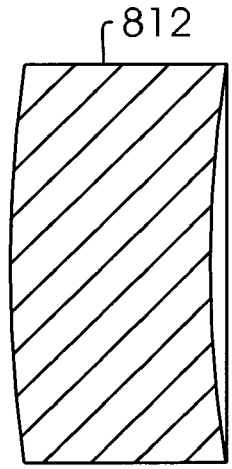
FIG. 8C is a sectional view of the plug of FIG. 8B taken substantially along the line C—C.

Considering now the upper section 122 of the hull 120 in still greater detail, as noted earlier, once the two sections 122 and 124 are interconnected and mounted to the external bracket 118, the dispersible fire extinguishing material 10 is introduced into the interior of the hull 120 via the hole H disposed in the upper section 122. As the material 150 is introduced within the hull 120, it fills the interior surrounding the device 114. After the hull 120 is completely full, a plug 812 (FIG. 8) is inserted into the hole H. In this regard, the plug 812 is bonded in the hull 120 in a snug friction tight fit without breaking or fracturing the hull wall.

Considering in still greater detail the igniter assembly 114, the igniter circuit 212 includes an igniter 218 having an upper mounting loop 218A and a pair of igniter legs 218 B and C respectively. A box like spacer 218D helps hold the legs 218B and C spaced apart from one another. The igniter 218 is an off-the-shelf item, manufactured by Estes Industries under part number 302301. The thermal switch 116, which forms part of the igniter circuit 212, is also an off-the-shelf item, manufactured by Uchiya under part number UP72, while the battery receptacle R is manufactured by Mouser Inc. under part number 121-0626/0.

While preferred embodiments of the present invention have been described in detail for purposes of illustration and the advantages of the details, variations have been set forth and are possible. For example, the device is shown with a pair of batteries as opposed to a single battery. In this regard, it is contemplated that a single battery could also be utilized to provide the necessary power for the device. In short then, variations are shown to illustrate the broader aspects of the present invention, so that further embodiments, modifications and variations are contemplated, all as determined by the spirit and scope of the appended claims.

We claim:

1. A fire extinguishing device, comprising:

a frangible housing;

an internal bracket supported within said housing by an external bracket, said internal bracket for supporting from below an explosive device and said external bracket for supporting from below said housing;

a fire extinguishing material contained within the housing; and an adjustable igniter for activating said explosive device in response to a sufficient amount of fire generated heat, whereby activation of said explosive device generates a sufficient explosive force to fragment said housing for dispersing said fire extinguishing material over a localized area, but not sufficient explosive force to dislodge said brackets from one another.

2. The fire extinguishing device of claim 1, wherein said housing comprises a substantially spherical body formed from two complimentary half-sections.

3. The fire extinguishing device of claim 1, wherein said housing includes a hollow interior and an opening through which the fire extinguishing material is introduced into the hollow interior of said housing.

4. The fire extinguishing device of claim 3, wherein said housing is composed of a plastic foam.

5. The fire extinguishing device of claim 4, wherein said plastic foam is polystyrene foam.

6. The fire extinguishing device of claim 5, wherein said polystyrene foam is expanded polystyrene foam.

7. The fire extinguishing device of claim 1, wherein said igniter is a pyrotechnic detonator.

8. The fire extinguishing device of claim 1, wherein said fire extinguishing material is a dry powder-type material.

9. The fire extinguishing device of claim 1, wherein said fire extinguishing material is ammonium phosphate.

10. The fire extinguishing device of claim 1, wherein said fire extinguishing material is sodium carbonate.

11. The fire extinguishing device of claim 1, wherein said igniter is an explosive igniter having an insufficient yield to deliver a debilitating concussive shock to a user at close proximity.

12. The fire extinguishing device according to claim 1, wherein the housing is formed of material that will fragment upon detonation by said explosive device into a plurality of fragments substantially harmless to a human in close proximity thereto; and wherein said explosive device is harmless to an auditory system of a human in proximity to said explosive device when detonated.

13. The fire extinguishing device of claim 1, wherein said housing includes a first and second complimentary sections, which mechanically interconnect.

14. The fire extinguishing device of claim 1, wherein said housing is shaped to uniformly disperse the fire extinguishing material after detonation of said explosive device.

15. The fire-extinguishing device of claim 1, wherein said housing is made from a low-density, rigid plastic foam.

16. The fire-extinguishing device according to claim 1, wherein at least one of the brackets is disc shaped.

17. The fire-extinguishing device according to claim 16, wherein at least another one of the brackets is U-shaped.

18. A fire extinguishing device comprising:

a pair of brackets for supporting a hollow frangible housing, said housing having an explosive device mounted therein with a thermal activator extending between said pair of brackets, wherein at least one of said brackets is surrounded by said housing and wherein at least another one of said brackets is disposed outside of said housing;

a fire extinguishing material located in the housing and substantially surrounding said explosive device;

wherein the housing is formed of material that will fragment upon detonation by said explosive device into a plurality of fragments substantially harmless to a human in close proximity thereto;

wherein said explosive device is harmless to an auditory system of a human in proximity to said explosive device when detonated; and wherein upon detonation said fire extinguishing material is dispersed over a localized area;

wherein at least one of the brackets is disc shaped;

wherein at least another one of the brackets is U-shaped; and wherein said disc shaped bracket has depending therefrom a two-tiered support, wherein a bottom portion of said support extends from said housing and is attached to said U-shaped bracket.

19. A fire extinguishing kit, comprising:

a fire extinguishing device including:

a hollow frangible containment vessel formed from a low-density, rigid plastic foam and having an internal bracket supported therein by an external bracket, said internal bracket for supporting from below an explosive device and said external bracket for supporting from below said hollow frangible containment vessel;

a fire extinguishing material contained within the containment vessel; and a thermal activator disposed between said brackets for activating said explosive device in response to a sufficient amount of fire generated heat, whereby activation of said explosive device generates a sufficient explosive force to fragment said containment vessel for dispersing said fire extinguishing material over a localized area, but not sufficient explosive force to dislodge said brackets from one another;

a set of mounting hardware for mounting the fire extinguishing device to a stationary surface; and a set of instructions for mounting the fire extinguishing device in a suitable fire preventing location.

20. A fire extinguishing device, comprising:

a hollow frangible containment housing;

an internal bracket supported within said housing by an external bracket, said internal bracket for supporting from below an explosive device and said external bracket for supporting from below said housing;

a fire extinguishing material contained within the housing; and a thermal activator disposed between said brackets for activating said explosive device in response to a sufficient amount of fire generated heat, whereby activation of said explosive device generates a sufficient explosive force to fragment said housing for dispersing said fire extinguishing material over a localized area, but not sufficient explosive force to dislodge said brackets from one another.

* * * * *